United States Patent [19]

Stein

[11] 4,326,394

[45] Apr. 27, 1982

[54] PORTABLE DOOR LOCK

[75] Inventor: Frederick Stein, Hollywood, Fla.

[73] Assignee: Sandra Lichtman, Philadelphia, Pa.

[21] Appl. No.: 180,465

[22] Filed: Aug. 22, 1980

[51] Int. Cl.[3] ..... E05B 73/00

[52] U.S. Cl. ..... 70/14; 292/292

[58] Field of Search ..... 70/14; 292/258, 288, 292/289, 290, 291, 292, 293, 294, 295, 296, 297, 298

[56] References Cited

U.S. PATENT DOCUMENTS

| | | | |
|---|---|---|---|
| 413,128 | 10/1889 | Brabson | 292/289 |
| 2,855,640 | 10/1958 | Rolen | 292/295 |
| 3,181,319 | 5/1965 | Hudon | 70/14 |
| 3,475,929 | 11/1969 | Weingart | 70/14 |
| 3,834,746 | 9/1974 | Hinden | 292/295 |

FOREIGN PATENT DOCUMENTS

| | | | |
|---|---|---|---|
| 372619 | 3/1923 | Fed. Rep. of Germany | 292/295 |
| 148717 | 8/1920 | United Kingdom | 292/292 |

*Primary Examiner*—Robert L. Wolfe

*Attorney, Agent, or Firm*—Morton J. Rosenberg

[57] ABSTRACT

A portable door lock (10) which is releasably coupled to door frame (12) and a door member (14) for positionally constraining the door member (14) to the door frame (12) when the portable door lock (10) is in an operational mode. The portable door lock (10) includes a door engagement mechanism (16) which is insertable between the door member (14) and the door frame (12) at the interface thereof. The door engagement mechanism (16) matingly engages the door member (14) on front and rear surfaces (20 and 22) and contacts the door frame (12) on a rear surface (24). A locking bar mechanism (62) is longitudinally displaceable on the door engagement mechanism (16) and extends across the interface (18) of the door member (14) and the door frame (12) for contacting the frontal surfaces (20 and 64) of the door frame (12) and the door member (14). A lock mechanism (82) is releasably securable to the door engagement mechanism (16) to prevent displacement of the locking bar mechanism (62) from the door engagement mechanism (16) for maintaining the door frame (12) and door member (14) in constrained relation each to the other, in order to minimize the possibility of an unauthorized opening of door member (14).

17 Claims, 2 Drawing Figures

PORTABLE DOOR LOCK

BACKGROUND OF THE INVENTION

1. Field of the Invention

This invention pertains to portable door locking systems. In particular, this invention relates to portable door locks which are used to augment the standard door lock. Further, this invention relates to a portable door locking system which matingly interfaces with a door member and passes through the interface of the door member and the door frame. More in particular, this invention pertains to a portable door lock system wherein a blocking or locking bar member passes across the interface of a closed door and door frame. Still further, this invention relates to a door locking system which provides for a standard lock device to block removal of locking bar member from the interface of a door frame and a door member. More in particular, this invention relates to a door locking system which is portable in nature and may be removed by the user subsequent to use.

2. Prior Art

Portable door locking systems are known in the art. The best prior art known to the inventor includes U.S. Pat. Nos. 584,677; 1,467,057; 2,536,941; 3,352,587; 3,421,787; 3,181,319; 3,589,761; 3,854,764; 3,527,489; 1,549,182; and, 583,363.

In some prior art systems, such as that provided in U.S. Pat. No. 584,677, there is provided a portable locking system which is insertable between a pair of door elements. However, in such prior art systems, hook sections are provided which are insertable within one of the door elements. Thus, such prior art systems are truly not completely removable from the door elements which is one of the main criteria of the subject invention concept.

In other prior art references, such as U.S. Pat. No. 1,467,057, where portable locking devices are shown and described, such also include insertable portions or members which are placed within an opening of the door jamb. This calls for disfiguring or marring of the door jamb due to the fact that such insertable members must be inserted within an opening formed in one of the elements. This does not allow such prior art systems to be universal in nature and causes utilization of such prior art systems on a selected number of doors which are adapted for use.

Other prior art references such as U.S. Pat. No. 3,352,587 also call for flanges which are insertable within recesses in the door frame. As previously described, this necessitates the disfiguring of the door or door frame and does not provide for universality of use.

Other prior art systems such as that shown in U.S. Pat. No. 2,536,941 provide for other types of door fastening devices. However, such does not provide for the general mating engagement of the mechanism as provided in the subject invention concept with respect to the door member. Such prior art systems necessitate excessive manufacturing cost and do not provide for the same holding or restraining concept as that of the subject invention concept.

SUMMARY OF THE INVENTION

A portable door lock which is releasably coupled to a door frame and a door member for positionally constraining the door member to the door frame. The portable door lock includes a door engagement mechanism insertable between the door member and the door frame at an interface thereof to allow mating engagement with the door member on a front and rear surface thereof, and for further contacting the door frame on a rear surface thereof. A locking bar mechanism is displaceable on the door engagement mechanism. The locking bar mechanism extends across the interface of the door member and the door frame for contacting frontal surfaces of the door frame and the door member. Additionally, a lock is releaseably securable to the door engagement mechanism to prevent displacement of a locking bar mechanism from the door engagement mechanism.

DESCRIPTION OF THE PREFERRED EMBODIMENTS

Figure 1:
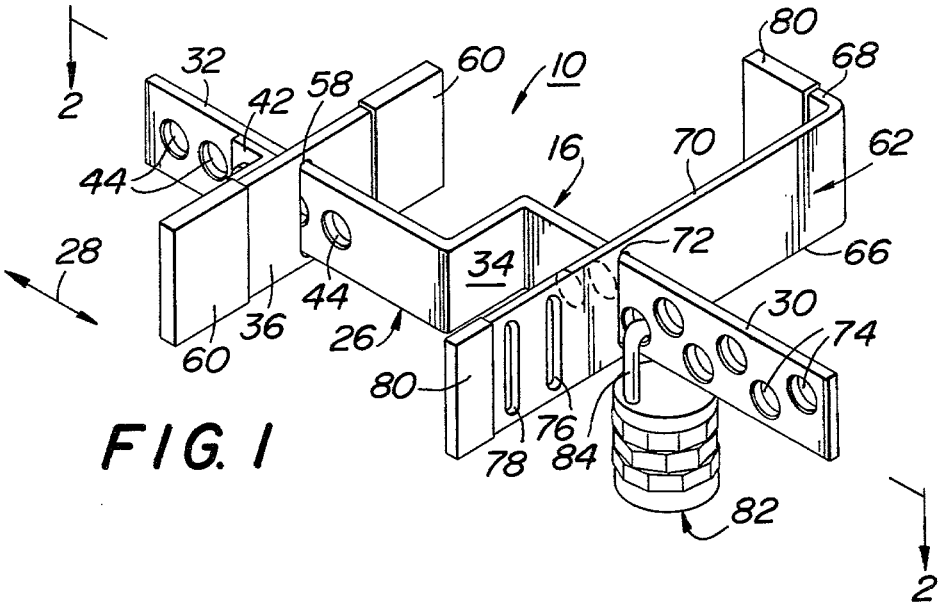
FIG. 1 is a perspective view of the portable door lock.
Figure 2:
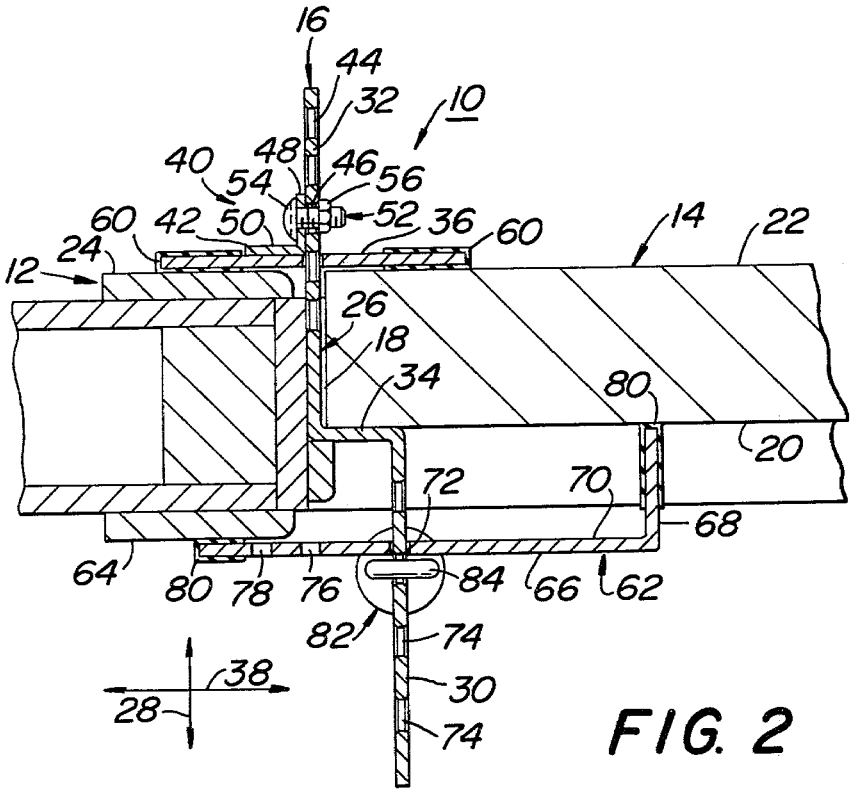
FIG. 2 is a sectional view taken along the Section Lines 2—2 of FIG. 1, and including a view of a door frame and a door member inserted within the portable door lock.

Referring now to FIGS. 1 and 2, there is shown a portable door lock 10 which is adapted for releasable coupling to door frame 14 and door member 12 in order to positionally constrain door member 12 to door frame 14 when mounted as is shown in FIG. 2.

In overall concept, portable door lock 10 is generally used in conjunction with a standard lock for a door to provide the user with an additional locking device which may be carried by the user. In particular, portable door lock 10 may have particular utilization for travelers where the user believes that an additional safety locking device may be advantageously provided in addition to the usual door lock found in most motel, hotel and inn rooms. Portable door lock 10 of the subject concept may be carried in the traveling case of the user and applied to the appropriate door member 14 and door frame 12 during times that the user leaves the particular room. When the user returns to the room, portable door lock 10 may be removed from door member 14 and corresponding door frame 12, and portable door lock 10 stored away for future use. Additionally, portable door lock 10 is sufficiently small in overall dimensions so that system 10 may be easily carried by the user in either his/her traveling case or carried within their pockets of their clothes.

Portable door lock 10 includes door engagement mechanism 16 which is clearly seen in FIG. 2, and is insertable between door member 14 and door frame 12 at interface 18. Door engagement mechanism 16 matingly engages door member 14 on door member front surface 20 and door member rear surface 22, and further contacts door frame 12 on door frame rear surface 24, as will be described in following paragraphs.

Door engagement mechanism 16 includes engagement bar member 26 which is generally Z-shaped in contour, as is seen in FIG. 1. Generally, engagement bar member 26 is formed in one-piece formation, and has a metal composition such as stainless steel or some like metal formation. The exact nature of the metallic formation or composition of engagement bar member 26 is not important to the inventive concept, as is herein described, with the exception that bar member 26 should be of sufficient structural integrity so as to resist removal by an intruder.

Engagement bar member 26 includes frontal section 30 and rear section 32 which extend in substantially longitudinal direction 28, as defined by directional arrows in FIGS. 1 and 2. Additionally, frontal section 30 and rear section 32 are directed in substantially parallel relationship each with respect to the other. Engagement bar frontal section 30 and rear section 32 are coupled each to the other by transversely directed engagement bar member transverse or shoulder section 34. As has been stated, the various sections 30, 32 and 34 of engagement bar member 26 may be formed in one piece formation through forging, bending, or some like technique.

Door engagement mechanism 16 further includes rear bar member 36 which is displaceable in a generally sliding contact in longitudinal direction 28 on engagement bar member rear section 32. As can be seen, rear bar member 36 extends across interface 18 of door frame 12 and door member 14 for contacting door frame 12 on rear surface 24 and door member 14 on rear surface 22. As can be seen, door member 14 is matingly engaged between rear bar member 36, shoulder or transverse section 34, and engagement bar member rear section 32, as shown in FIG. 2.

Door member 14 may be of differing thickness and thus, there is provided adjustment mechanism 40, adjusting for varying distances in longitudinal direction 28 between rear bar member 36 and transversely directed engagement bar member shoulder section 34 in order to provide mating engagement of door member 14 therebetween irrespective of the thickness dimension of door member 14. Adjustment mechanism 40 includes mating adjustment member 42 which is securable to engagement bar member rear section 32 through at least one of a plurality of longitudinally displaced engagement bar member rear section through openings 44.

Mating adjustment member 42 is generally L-shaped in contour and includes adjustment member opening 46 which is formed through first arm 48 and in operation is alignable with one of engagement bar rear section through openings 44.

Adjustment mechanism 40 also includes securement mechanism 52 which passes through aligned openings 46 and 44 for fixedly securing L-shaped mating adjustment member 42 to rear bar member rear section 32, as is seen in FIG. 2. Securement mechanism 52 includes bolt member 54 having a head diameter greater than aligned openings 44 and 46 and nut member 56 which is threadedly engageable with bolt member 54.

Rear bar member 36 includes rear bar member slot 58 which is a through opening of dimension greater than the dimension of engagement bar member rear section 32 to permit rear bar member 36 to slide in longitudinal direction 28 when rear bar member 36 is mounted on engagement bar member 26. Obviously, the dimension of rear bar member through opening slot 58 should be dimensioned to be slightly greater than the overall perimeter dimension of rear section 32 in order to allow sliding displacement of rear bar member 36, while at the same time, not providing play for rotational displacement about a vertical axis to any great extent.

Thus, in operation, it is seen that in a particular door member 14, rear bar member 36 which passes in transverse direction 38 may be adjusted in longitudinal direction 28 to the particular thickness of door member 14. Adjustment is provided by placement or displacement of rear bar member 36 on rear section 32 of engagement bar member 26 in a manner such that frontal and rear surfaces 20 and 22 of door member 14 are snugly captured between rear bar member 36 and shoulder section 34. At this point, mating adjustment member 42 is positionally located in a manner such that adjustment member second arm 50 is placed in close proximity or contact with door frame rear surface 24 and appropriate through openings 44 and 46 are aligned. Bolt member 54 is inserted through aligned openings 44 and 46, and nut member 56 is threadedly secured thereto on an opposing surface of rear section 32. In this manner, door member 14 is substantially captured between rear bar member 36 and shoulder or transverse section 34 of engagement bar member 26.

In order to protect rear surface 22 of door member 14, as well as rear surface 24 of door frame 12, rear bar member 36 may have formed thereon at least or partially on surfaces which contact surfaces 22 and 24, a resilient type of coating material. Resilient coating material 60 may be a rubber composition, plastic, or some like material which will protect surfaces 22 and 24 from abrasion or other types of marring. If a rubber composition is used, since rear bar member 36 may be formed of a generally steel composition, coating may be accomplished by dipping or some like technique which will protect the contacting surfaces, as has been described.

Portable door lock 10 further includes a locking bar mechanism 62 which is displaceable on door engagement mechanism 16. In particular, locking bar mechanism 62 is seen to be adaptable for displacement in longitudinal direction 28 on engagement bar member frontal section 30 for purposes to be described in following paragraphs. Locking bar mechanism 62 extends in transverse direction 38 across interface 18 of door member 14 and door frame 12 to contact door member frontal surface 20 and door frame frontal surface 64. Locking bar mechanism 62 is shown to include L-shaped locking bar member 66 which is slidably displaceable on engagement bar member frontal section 30. As can be seen, locking bar member 66 includes locking bar member first arm 68 which contacts door member frontal surface 20 and also includes locking bar member second arm 70 which is adapted for contact of door frame frontal surface 64. First and second arms 68 and 70, respectively, are directed in a substantially normal direction each to the other and may be formed in one-piece formation much in the same manner as was provided for engagement bar member 26. Locking bar member 66 may be formed of steel, or some like metal composition, which has the structural integrity to prevent removal by an unauthorized person.

Locking bar member 66 includes locking bar through slot 72 formed through locking bar member second arm 70, as is seen in FIGS. 1 and 2. Through slot 72 includes an opening dimension greater than the perimeter dimension of engagement bar member frontal section 30 in an amount such that locking bar member 66 may be slidably displaceable in longitudinal direction 28. However, the clearance between the perimeter dimension of engagement bar member frontal section 30 and locking bar through slot 72 should be low enough in order that excessive play about a vertically directed axis is minimized.

L-shaped locking bar member 66 is seen to include a plurality of transversely displaced through slots 76 and 78 of the generally same dimension opening as locking bar through slot 72. In this manner, it is clearly seen that through slots 72, 76 and 78 permit interface adjustment in transverse direction 38 of overall locking bar member 66.

Additionally, as was the case with rear bar member 36, L-shaped locking bar member 66 may be at least partially coated with a resilient coating material 80 formed on surfaces which contact door member frontal surface 20 and door frame frontal surface 64. In this manner, abrasion or other marring of door member 14 and/or door frame 12, may be minimized. Resilient coating material 80 may be generally formed of a rubber composition, plastic, or some like material which has resilience above that which may be encountered by the steel composition forming the structural component of locking bar member 66.

Engagement bar member frontal section 30 includes a plurality of longitudinally displaced openings 74 formed therethrough, as is clearly seen in FIG. 1. Opening 74 may be staggered, as is shown in FIG. 1, to provide closer adjustment in maintaining locking bar member 66 against door frame 12 and door member 14. Alternatively, opening 74 may be aligned in longitudinal direction 28.

Lock mechanism 82 seems to be releasably securable to door engagement mechanism 16 to prevent displacement of locking bar member 66 from door engagement mechanism 16. Lock 82 may be a standard key operated padlock, or dial operated lock, as is shown. Such lock mechanisms 82 are commercially available, and not important to the inventive concept, with the exception that such interface with the remaining elements of portable door lock 10 as has been previously described. Lock mechanism 82 includes lock bar 84 which is passed through one opening 74 to locking bar member 66, as is shown. In this manner, locking bar member 66 which passes across interface 18 and contacts frontal surfaces 64 and 20 of door frame 12, and door member 14, respectively, has its path blocked in longitudinal direction 28 and prevents removal of locking bar member 66 from frontal section 30 of engagement bar member 26. In this manner, until lock bar 84 is removed from openings 74, door member 14 is fixedly constrained in the closed position to door frame 12.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A portable door lock releasably coupled to a door frame and a door member for positionally constraining said door member to said door frame, comprising:

(a) door engagement means insertable between said door member and said door frame at an interface thereof for matingly engaging said door member on a front and rear surface thereof and for contacting said door frame on a rear surface thereof;

(b) locking bar means displaceable on said door engagement means, said locking bar means extending across said interface of said door member and said door frame for contacting frontal surfaces of said door frame and said door member; and, (c) a lock releasably securable to said door engagement means to prevent displacement of said locking bar means from said door engagement means.

2. The portable door lock as recited in claim 1, where said door engagement means includes:

(a) an engagement bar member having a frontal section and a rear section extending in a longitudinal direction in substantially parallel relationship each with respect to the other, said frontal and rear section being coupled each to the other by a transversely directed engagement bar member transverse section; and, (b) a rear bar member slidably displaceable in said longitudinal direction on said engagement bar member rear section, said rear bar member extending across said interface of said door frame and said door member for contacting said door frame rear surface and said door member rear surface.

3. The portable door lock as recited in claim 2 where said engagement bar member is formed in one-piece construction.

4. The portable door lock as recited in claim 2 including means for adjusting a longitudinal distance between said rear bar member and said transversely directed shoulder section of said engagement bar member for matingly engaging said door member therebetween.

5. The portable door lock as recited in claim 4 where said adjustment means includes a mating adjustment member securable to said engagement bar member rear section through at least one of a plurality of longitudinally displaced engagement bar member rear section through openings.

6. The portable door lock as recited in claim 5 where said adjustment means includes:

(a) an L-shaped mating adjustment member having an opening formed through a first arm, said mating adjustment member opening being aligned with one of said engagement bar member rear section through openings; and, (b) securement means passing through said aligned openings for fixedly securing said L-shaped mating adjustment member to said rear bar member rear section.

7. The portable door lock as recited in claim 6 where said securement means includes:

(a) a bolt member having a head diameter greater than said aligned openings; and, (b) a nut member threadedly engageable with said bolt member.

8. The portable door lock as recited in claim 2, where said rear bar member includes a slot through opening of dimension greater than the dimension of said engagement bar member rear section to allow said rear bar member to slide in said longitudinal direction when said rear bar member is mounted on said engagement bar member.

9. The portable door lock as recited in claim 2, where said rear bar member includes a resilient coating material formed at least partially on surfaces which contact said door member rear surface and said door frame rear surface.

10. The portable door lock as recited in claim 9 where said resilient coating material is a rubber composition.

11. The portable door lock as recited in claim 2 where said locking bar means includes an L-shaped locking bar member slidably displaceable in said longitudinal direction on said engagement bar member frontal section.

12. The portable door lock as recited in claim 11 where said L-shaped locking bar member includes at least one locking bar member through slot formed therethrough, said locking bar member through slot having an opening dimension greater than the dimension of said engagement bar member frontal section.

13. The portable door lock as recited in claim 12 where said L-shaped locking bar member includes a plurality of transversely displaced through slots to permit interface adjustment of said locking bar member.

14. The portable door lock as recited in claim 11 where said L-shaped locking bar is at least partially coated with a resilient coating material formed at least partially on surfaces which contact said door member front surface and said door frame front surface.

15. The portable door lock as recited in claim 14 where said resilient coating material is a rubber composition.

16. The portable door lock as recited in claim 11 where said engagement bar member frontal section includes a plurality of longitudinally displaced frontal section openings, said lock being engageable with one of said openings to intercept the displacement path of said locking bar member on said engagement bar member frontal section.

17. The portable door lock as recited in claim 16 where said frontal section openings are provided in a staggered opening pattern.

* * * * *